US008776552B2

(12) United States Patent
Lee et al.

(10) Patent No.: US 8,776,552 B2
(45) Date of Patent: Jul. 15, 2014

(54) WASHING MACHINE AND LAUNDRY AMOUNT DETECTION DEVICE THEREOF

(75) Inventors: Sang Jun Lee, Suwon-si (KR); Jeong Su Han, Suwon-si (KR); Hyen Young Choi, Suwon-si (KR); Ji Hoon Ha, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 835 days.

(21) Appl. No.: 12/923,902

(22) Filed: Oct. 13, 2010

(65) Prior Publication Data

US 2011/0113567 A1 May 19, 2011

(30) Foreign Application Priority Data

Nov. 16, 2009 (KR) ..... 10-2009-0110375

(51) Int. Cl.
*D06F 37/22* (2006.01)
*D06F 33/02* (2006.01)

(52) U.S. Cl.
USPC ..... 68/12.04; 68/12.27; 68/23.1; 68/140

(58) Field of Classification Search
USPC ..... 68/12.04, 12.27, 23.1, 24, 140
See application file for complete search history.

(56) References Cited

U.S. PATENT DOCUMENTS

| | | | | |
|---|---|---|---|---|
| 4,742,698 | A * | 5/1988 | Torita | 68/12.04 |
| 6,065,170 | A * | 5/2000 | Jang | 8/158 |
| 6,460,381 | B1 * | 10/2002 | Yoshida et al. | 68/12.04 |
| 7,293,313 | B2 * | 11/2007 | Beier et al. | 8/159 |
| 7,530,244 | B2 * | 5/2009 | Inuzuka et al. | 68/24 |
| 8,302,433 | B2 * | 11/2012 | Han et al. | 68/23.1 |
| 8,312,581 | B2 * | 11/2012 | Pelczer | 8/158 |
| 2005/0022315 | A1 * | 2/2005 | Beier et al. | 8/158 |

FOREIGN PATENT DOCUMENTS

| | | | | |
|---|---|---|---|---|
| CN | 1475768 | | 2/2004 | |
| DE | 298 12 393 | | 11/1999 | |
| DE | 199 49 217 | | 4/2001 | |
| DE | 103 34 572 | | 8/2004 | |
| EP | 1243686 | A1 * | 9/2002 | D06F 37/22 |
| EP | 1 988 206 | | 11/2008 | |
| FR | 2898912 | | 9/2007 | |
| FR | 2898912 | A1 * | 9/2007 | |
| JP | 54147661 | A * | 11/1979 | D06F 33/02 |
| JP | 2004-353749 | | 12/2004 | |
| KR | 10-0513502 | | 9/2005 | |
| KR | 10-2006-0031065 | | 4/2006 | |

OTHER PUBLICATIONS

European Search Report dated Apr. 12, 2011, issued in European Application No. 10187109.3.
Russian Office Action issued May 17, 2012 in corresponding Russian Patent Application No. 2010143272.
Chinese Office Action issued in corresponding Chinese Patent Application No. 2014011600834720.

* cited by examiner

*Primary Examiner* — Joseph L Perrin
(74) *Attorney, Agent, or Firm* — Staas & Halsey LLP

(57) ABSTRACT

A washing machine and a laundry amount detection device thereof. The washing machine includes a cabinet, a tub provided in the cabinet, an elastic member to elastically support the tub at the cabinet, and a laundry amount detection device to detect an amount of laundry placed in the tub using a deformation amount of the elastic member.

21 Claims, 8 Drawing Sheets

WASHING MACHINE AND LAUNDRY AMOUNT DETECTION DEVICE THEREOF

CROSS-REFERENCE TO RELATED APPLICATIONS

This application claims the benefit of Korean Patent Application No. 2009-0110375, filed on Nov. 16, 2009 in the Korean Intellectual Property Office, the disclosure of which is incorporated herein by reference.

BACKGROUND

1. Field

Embodiments relate to a washing machine and a laundry amount detection device thereof.

2. Description of the Related Art

A washing machine is an apparatus that washes clothing using mechanical force. The washing machine mainly uses a motor as a main power source, and performs washing, rinsing and spin-drying processes using detergent and water to remove contaminants from the clothing.

The washing machine measures an amount of clothing to adjust an amount of detergent, water and electricity to be used. The washing machine measures an amount of laundry and uses water and electricity in proportion to the measured amount of the laundry to efficiently use energy.

The washing machine may measure an amount of laundry using two methods. A first method is to use the change in inertia of a drum based on the weight of laundry. A second method is to use the change in weight of a tub based on the weight of laundry. The first method indirectly estimates the weight of laundry, whereas the second method directly measures the weight of laundry.

SUMMARY

Therefore, it is an aspect to provide a washing machine including a device to accurately measure an amount of laundry.

Additional aspects of the invention will be set forth in part in the description which follows and, in part, will be apparent from the description, or may be learned by practice of the invention.

In accordance with one aspect, a washing machine includes a cabinet, a tub provided in the cabinet, an elastic member to elastically support the tub at the cabinet, and a laundry amount detection device to detect an amount of laundry placed in the tub using a deformation amount of the elastic member.

At least a portion of the laundry amount detection device may be configured to move relative to deformation of the elastic member.

The laundry amount detection device may include a deformation amount measurement unit to measure the deformation amount of the elastic member, and the deformation amount measurement unit may include a load cell having an elastically deformable body and a strain gauge and a position fixing member to fix the load cell to the elastic member.

The laundry amount detection device may further include a controller to transmit a value measured by the deformation amount measurement unit to a microprocessor of the washing machine, and the microprocessor may receive the measured value from the controller and calculate the amount of the laundry.

The laundry amount detection device may further include a controller to calculate the amount of the laundry using the value measured by the deformation amount measurement unit and to transmit the calculated amount of the laundry to a microprocessor of the washing machine.

The elastically deformable body may be deformed in proportion to deformation of the elastic member.

The elastically deformable body may be arranged in a longitudinal direction of the elastic member and may be formed in an arc shape.

The elastically deformable body may be disposed in a predetermined space inside the elastic member.

The position fixing member may include a stationary part coupled to the elastic member and a movable part coupled to the load cell, and the movable part may be pivotably coupled to the stationary part.

The stationary part may have an elastic member coupling part, and the elastic member coupling part may be threadedly coupled to the elastic member.

The movable part may have an elastically deformable body coupling part, and the elastically deformable body coupling part may be threadedly coupled to the elastically deformable body.

The stationary part and the movable part may be coupled to each other via a pin.

The position fixing member may include a first position fixing member and a second position fixing member, and the first position fixing member may connect one side of the load cell and one side of the elastic member while the second position fixing member may connect the other side of the load cell and the other side of the elastic member.

The elastic member may include a spring.

The washing machine may further include a control panel to display the amount of the laundry measured by the laundry amount detection device.

The washing machine may further include a control panel to display an amount of detergent or washing time previously set according to the amount of the laundry measured by the laundry amount detection device.

In accordance with another aspect, a laundry amount detection device includes an elastic member to elastically support a tub at a cabinet and a deformation amount measurement unit to measure a deformation amount of the elastic member to detect an amount of laundry placed in the tub.

At least a portion of the laundry amount detection device may be configured to move relative to deformation of the elastic member.

The laundry amount detection device may further include a controller to calculate the amount of the laundry using a value measured by the deformation amount measurement unit.

The deformation amount measurement unit may include a load cell having an elastically deformable body and a strain gauge and a position fixing member to fix the load cell to the elastic member.

The position fixing member may include a stationary part coupled to the elastic member and a movable part coupled to the load cell, and the movable part may be pivotably coupled to the stationary part.

The stationary part and the movable part may be coupled to each other via a pin.

The elastically deformable body may be disposed in a predetermined space inside the elastic member.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
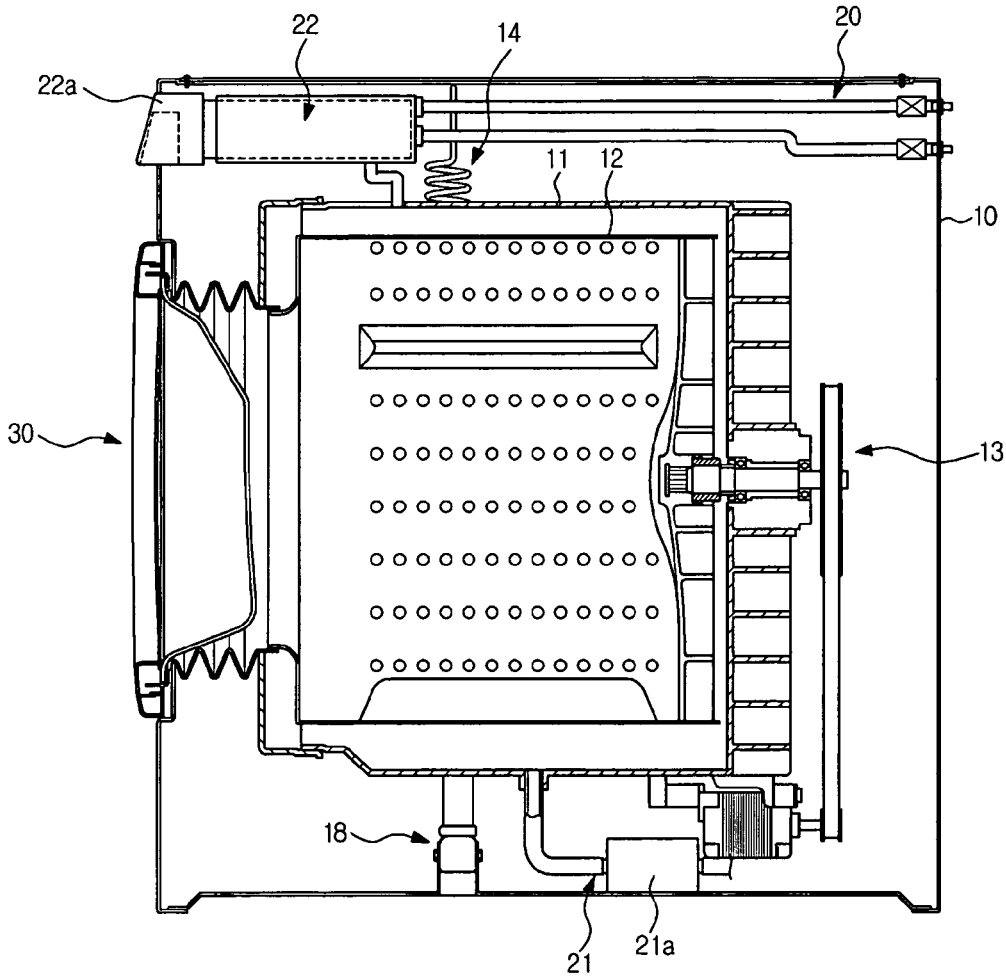
FIG. 1 is a side sectional view illustrating the principal construction of a washing machine according to an embodiment.

Reference will now be made in detail to the embodiments of the present invention, examples of which are illustrated in the accompanying drawings, wherein like reference numerals refer to like elements throughout.

Figure 2:
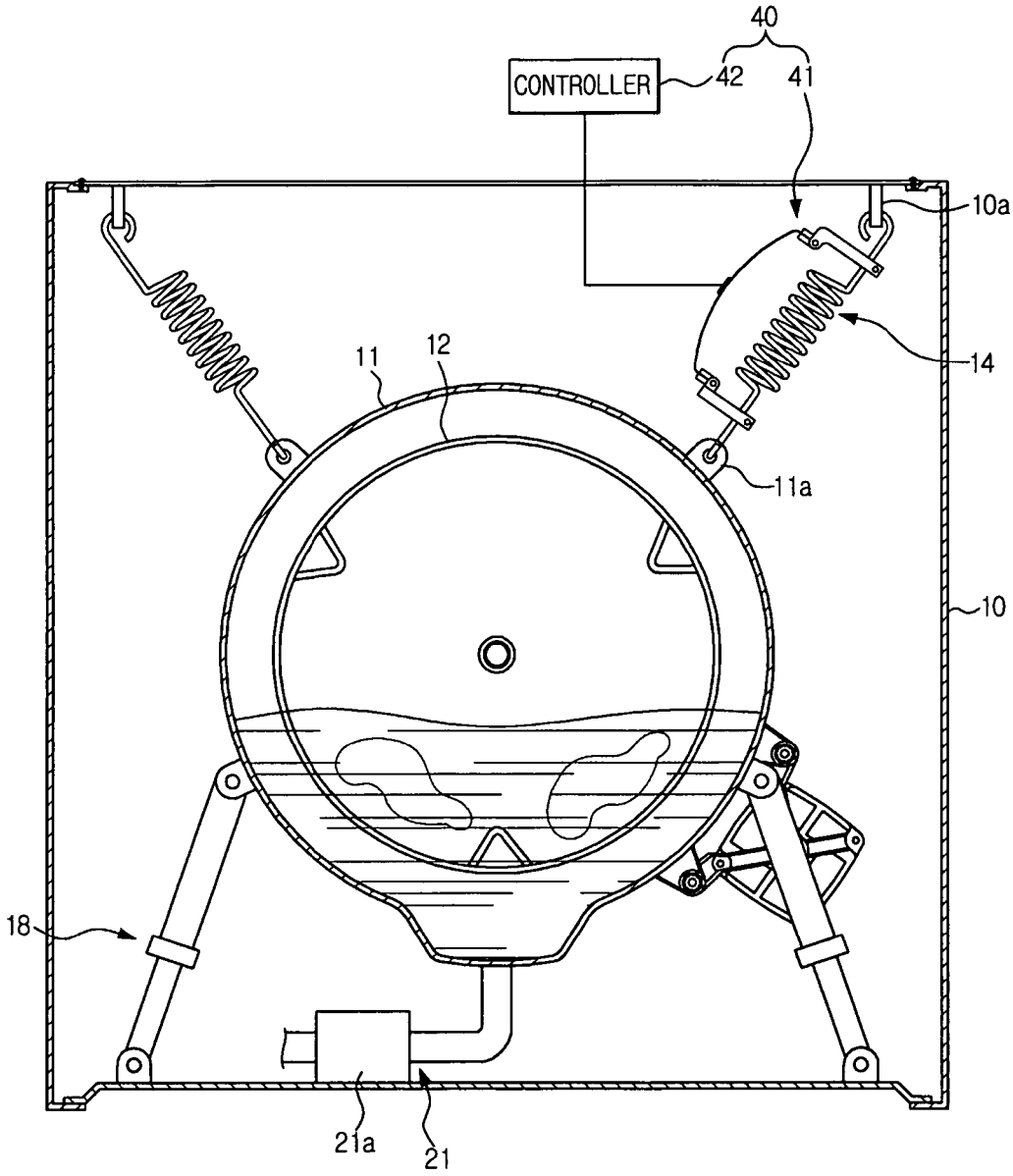
FIG. 2 is a front sectional view illustrating the principal construction of the washing machine according to the embodiment.

FIG. 1 is a side sectional view illustrating the principal construction of a washing machine according to an embodiment, and FIG. 2 is a front sectional view illustrating the principal construction of the washing machine according to the embodiment.

As shown in FIGS. 1 and 2, the washing machine includes a cabinet 10, a tub 11 provided in the cabinet 10, a drum 12 rotatably provided in the tub 11, and a drive unit 13 to drive the drum 12.

The tub 11 is supported at the cabinet 10 by at least one elastic member 14 and at least one damping member 18. The elastic member 14 may include a spring. The damping member 18 may include an oil damper. The elastic member 14 and the damping member 18 absorb vibration or impact generated from the tub 11 and the drum 12 during the operation of the drive unit 13.

The washing machine may further include a water supply unit 20, a drainage unit 21, and a detergent supply unit 22.

The water supply unit 20 is connected to a water supply source outside the washing machine to supply wash water into the tub 11. The drainage unit 21 drains wash water out of the washing machine during a rinsing cycle or a spin-drying cycle. The detergent supply unit 22 is connected to the water supply unit 20 to supply detergent together with the wash water supplied through the water supply unit 20.

The water supply unit 20, the drainage unit 21, and the detergent supply unit 22 each may include a valve and channels. The drainage unit 21 may further include a drainage pump 21*a*. The detergent supply unit 22 may further include a detergent box 22*a* to store detergent.

The washing machine may further include a door 30 to open and close the front of the cabinet 10.

When a user wishes to wash laundry, the user may open the door 30 and put the laundry into the drum 12. When the washing is completed, the user may open the door 30 and withdraw the laundry from the drum 12.

Also, the washing machine may further include a laundry amount detection device 40 to measure the amount of laundry.

The laundry amount detection device 40 includes a deformation amount measurement unit 41 to measure a deformation amount of the elastic member 14 and a controller 42 to calculate the amount of laundry using a value measured by the deformation amount measurement unit 41 or transmit the value measured by the deformation amount measurement unit 41 to a microprocessor (not shown) of the washing machine. The microprocessor may receive the value measured by the deformation amount measurement unit 41 from the controller 42 and calculate the amount of laundry.

Figure 3:
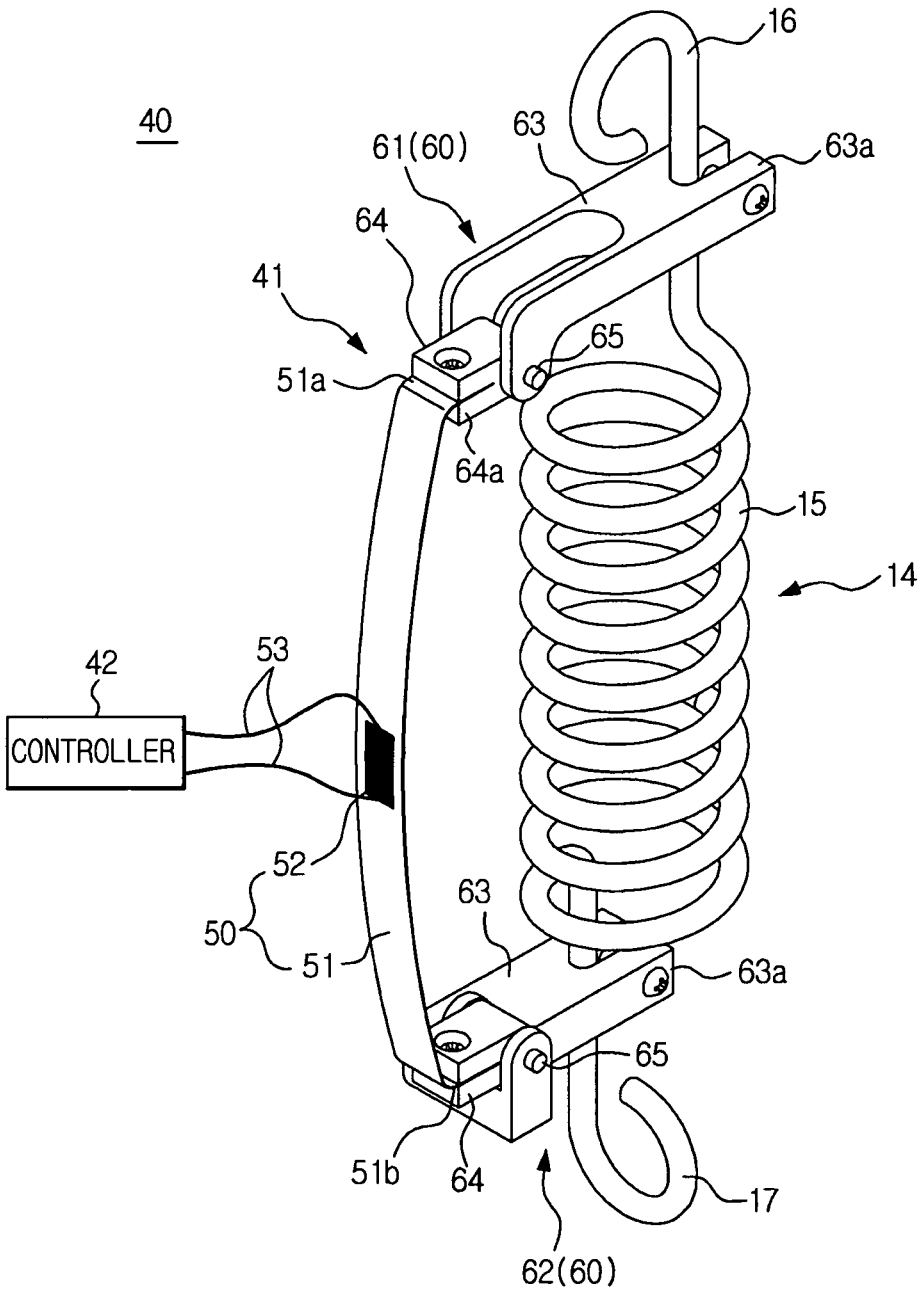
FIG. 3 is a perspective view of a laundry amount detection device according to an embodiment.
Figure 4:
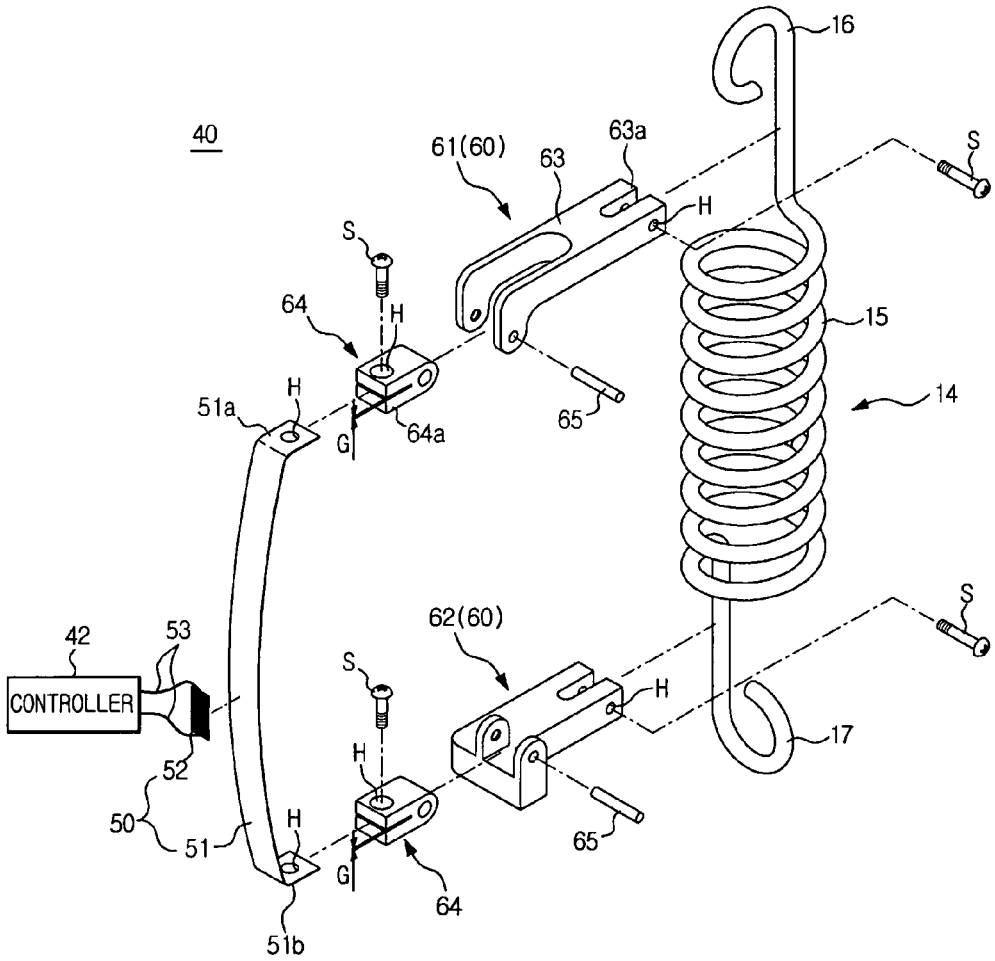
FIG. 4 is an exploded perspective view of the laundry amount detection device according to an embodiment.

FIG. 3 is a perspective view of a laundry amount detection device according to an embodiment of the present invention, and FIG. 4 is an exploded perspective view of the laundry amount detection device according to an embodiment of the present invention.

As shown in FIGS. 1 to 4, the elastic member 14 may be configured to elastically support the tub 11 at the cabinet 10. The elastic member 14 includes a spiral part 15, a first hook 16 provided at one end of the spiral part 15, and a second hook 17 provided at the other end of the spiral part 15. The first hook 16 of the elastic member 14 may be fixed to a first holder 10*a* of the cabinet 10, and the second hook 17 of the elastic member 14 may be fixed to a second holder 11*a* of the cabinet 10.

The elastic member 14 may be deformed in proportion to the amount of laundry. As laundry is placed in the tub 11, the weight of the tub 11 is changed. As a result, force applied to the elastic member 14 is changed, and therefore, the length of the elastic member 14 is increased. That is, since the elastic member 14 is deformed in proportion to the amount of laundry placed in the tub 11, the amount of laundry placed in the tub 11 may be detected by measuring a deformation amount of the elastic member 14.

The deformation amount measurement unit 41 may be configured to measure a deformation amount of the elastic member 14. To this end, the deformation amount measurement unit 41 is configured to move relative to the deformation of the elastic member 14. That is, since the deformation amount measurement unit 41 is deformed in proportion to the deformation of the elastic member 14, a deformation amount of the elastic member 14 may be measured by measuring a deformation amount of the deformation amount measurement unit 41.

The deformation amount measurement unit 41 may include a load cell 50 configured to be deformed in proportion to the deformation of the elastic member 14 and a position fixing member 60 to fix the load cell 50 to the elastic member 14.

The load cell 50 may include an elastically deformable body 51 and a strain gauge 52.

The elastically deformable body 51 may be provided at the elastic member 14 such that the elastically deformable body 51 is physically deformed by elastic deformation of the elastic member 14. The elastically deformable body 51 may be arranged in the longitudinal direction of the elastic member 14. An upper end 51*a* of the elastically deformable body 51 may be fixed to the first hook 16 of the elastic member 14 by a first position fixing member 61, and a lower end 51*b* of the elastically deformable body 51 may be fixed to the second hook 17 of the elastic member 14 by a second position fixing member 62. In this structure, the elastically deformable body 51 is supported at two points at the elastic member and thus is securely fixed to the elastic member 14. That is, since the elastically deformable body 51 is deformed in proportion to a deformation amount of the elastic member 14, the deformation amount of the elastic member 14 may be measured based on a deformation amount of the elastically deformable body 51.

The elastically deformable body 51 may be formed in an arc shape. The arc-shaped elastically deformable body 51 may be easily bent in the longitudinal direction of the elastic member 14 when the elastic member is deformed in the longitudinal direction thereof. Also, stress is prevented from being concentrated at a specific point of the arc-shaped elastically deformable body 51, whereby durability of the elastically deformable body 51 is improved.

The strain gauge 52 may be attached to the elastically deformable body 51. The strain gauge 52 may include electric wires 53 at opposite ends thereof. The strain gauge 52 outputs electric resistance corresponding to physical deformation of the elastically deformable body 51. That is, since an electric resistance output value of the strain gauge 52 is proportional to a deformation amount of the elastically deformable body 51, the deformation amount of the elastically deformable body 51 may be measured based on the electric resistance output value of the strain gauge 52.

Meanwhile, the controller 42 may be connected to the strain gauge 52 via the electric wires 53. The controller 42 inversely calculates the electric resistance output value of the strain gauge 52 to detect an amount of laundry. This is because the electric resistance output value of the strain gauge 52 is proportional to a deformation amount of the elastically deformable body 51, the deformation amount of the elastically deformable body 51 is proportional to a deformation amount of the elastic member 14, and the deformation amount of the elastic member 14 is proportional to an amount of laundry.

The controller 42 may be configured to control an output value of the strain gauge 52 to correspond to an amount of laundry placed in the tub 11 and to control the measured amount of the laundry or an appropriate amount of detergent and washing time based on the measured amount of the laundry to be displayed on a control panel (not shown). The controller 42 may include a microprocessor built in a machine body of the washing machine or an additional component different from the microprocessor built in the machine body of the washing machine.

In another construction example, the controller 42 may be configured to control the measured amount of the laundry to be transmitted to the microprocessor of the washing machine, and the microprocessor may be configured to control the amount of the laundry, transmitted to the microprocessor, or an appropriate amount of detergent and washing time based on the amount of the laundry, transmitted to the microprocessor, to be displayed on the control panel.

In a further construction example, the controller 42 may transmit the electric resistance output value of the strain gauge 52, i.e., the deformation amount of the elastic member 14, to the microprocessor. At this time, the microprocessor may control an output value of the strain gauge 52 to correspond to an amount of laundry placed in the tub 11 to measure the amount of the laundry. Subsequently, the microprocessor may control the measured amount of the laundry or an appropriate amount of detergent and washing time based on the measured amount of the laundry to be displayed on the control panel.

Meanwhile, as previously described, the position fixing member 60 may include the first position fixing member 61 coupled to the first hook 16 of the elastic member 14 and the second position fixing member 62 coupled to the second hook 17 of the elastic member 14.

The first position fixing member 61 may include a stationary part 63 and a movable part 64. The stationary part 63 may have an elastic member coupling part 63*a*. The elastic member coupling part 63*a* may be formed in a U shape. The elastic member coupling part 63*a* may be provided with a screw coupling hole H. The first position fixing member 61 is securely fixed to the elastic member 14 by fitting the elastic member coupling part 63*a* of the stationary part 63 on the first hook 16 of the elastic member and inserting a screw S into the screw coupling hole H.

The movable part 64 may include an elastically deformable body coupling part 64*a*. The elastically deformable body coupling part 64*a* may have a predetermined gap G into which the upper end 51*a* of the elastically deformable body 51 is inserted. The elastically deformable body coupling part 64*a* may be provided with a screw coupling hole H. When the upper end 51*a* of the elastically deformable body 51 is inserted into the predetermined gap G of the elastically deformable body coupling part 64*a*, a screw coupling hole H of the upper end 51*a* of the elastically deformable body 51 may be aligned with the screw coupling hole H of the elastically deformable body coupling part 64*a* of the movable part 64. At this time, a screw S is inserted into the screw coupling holes H, with the result that the elastically deformable body 51 is fixed by the first position fixing member 61.

Meanwhile, the stationary part 63 and the movable part 64 are coupled to each other via a pin 65. The movable part 64 may be pivotably coupled to the stationary part 63 via the pin 65. That is, the movable part 64 may freely pivot about the pin 65 functioning as a pivot shaft. When vibration or impact generated from the tub 11 is absorbed by the elastic member 14 during a washing process, the vibration or impact is transmitted to the deformation amount measurement unit 41. At this time, the vibration or impact may be dispersed or decreased by the pivoting motion of the movable part 64. The pin 65 coupling structure of the stationary part 63 and the movable part 64 may prevent damage to the elastically deformable body 51 and secure durability of the elastically deformable body 51.

The second position fixing member 62 may also include a stationary part 63 and a movable part 64. The stationary part 63 may have an elastic member coupling part 63*a*. The movable part 64 may include an elastically deformable body coupling part 64*a*. The coupling between the stationary part 63 and the movable part 64 of the second position fixing member 62 is performed in the same manner as in the first position fixing member 61, and therefore, a detailed description thereof is omitted.

Hereinafter, the operation of the washing machine according to the embodiment of the present invention will be described in detail.

Figure 5:
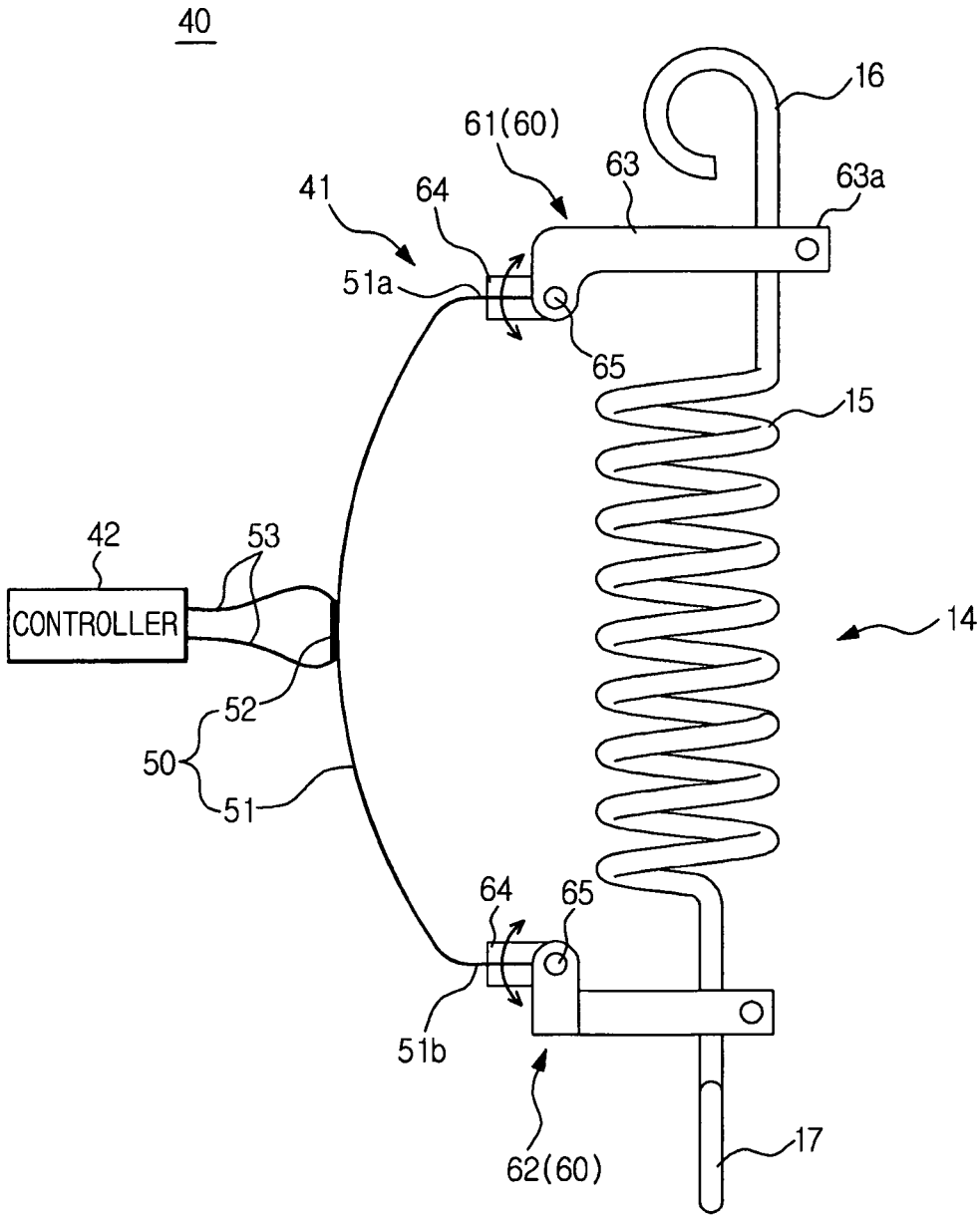
FIG. 5 is a sectional view of a deformation amount measurement unit before laundry is placed in the washing machine according to the embodiment.
Figure 6:
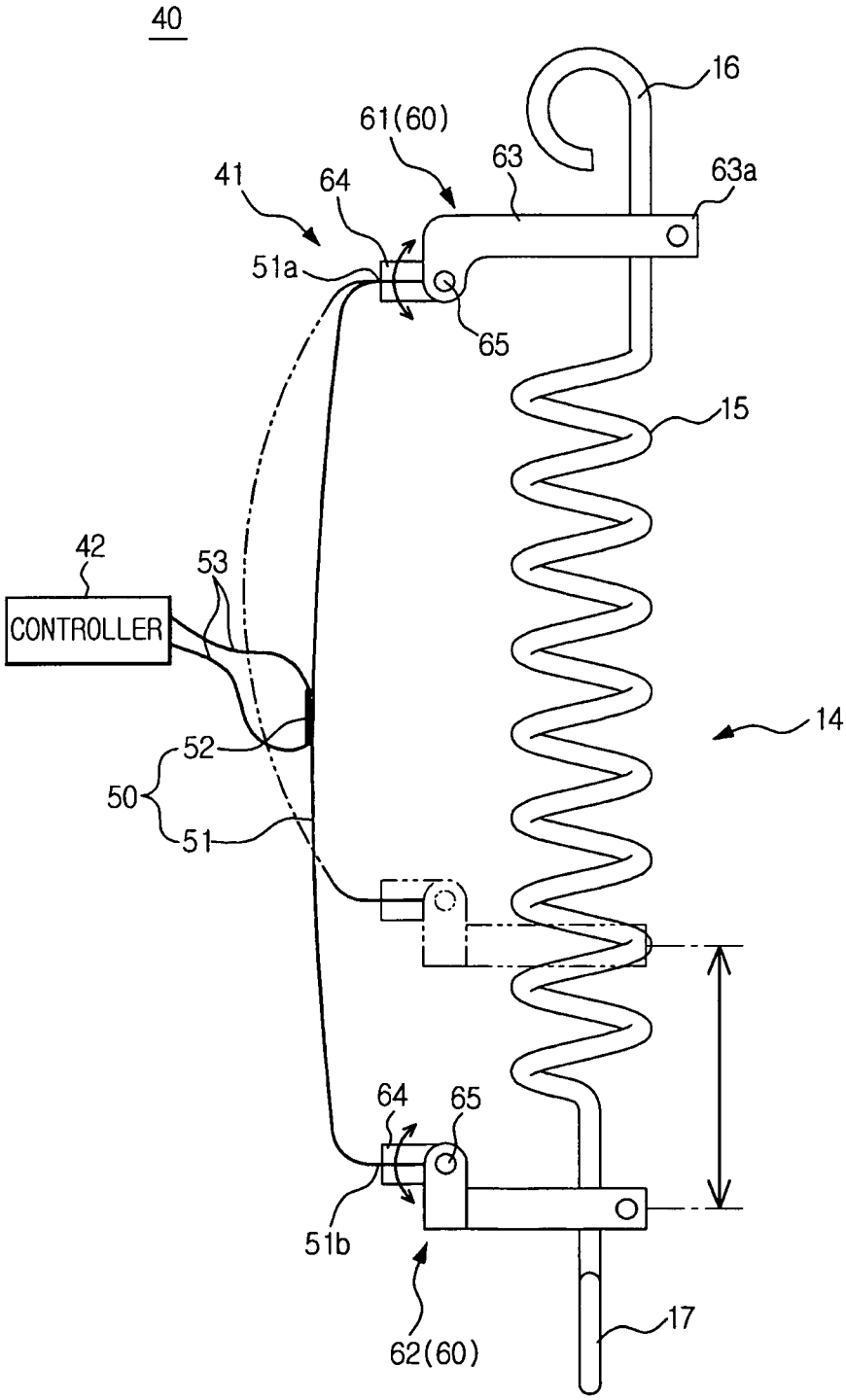
FIG. 6 is a sectional view of the deformation amount measurement unit after laundry is placed in the washing machine according to the embodiment.
Figure 7:
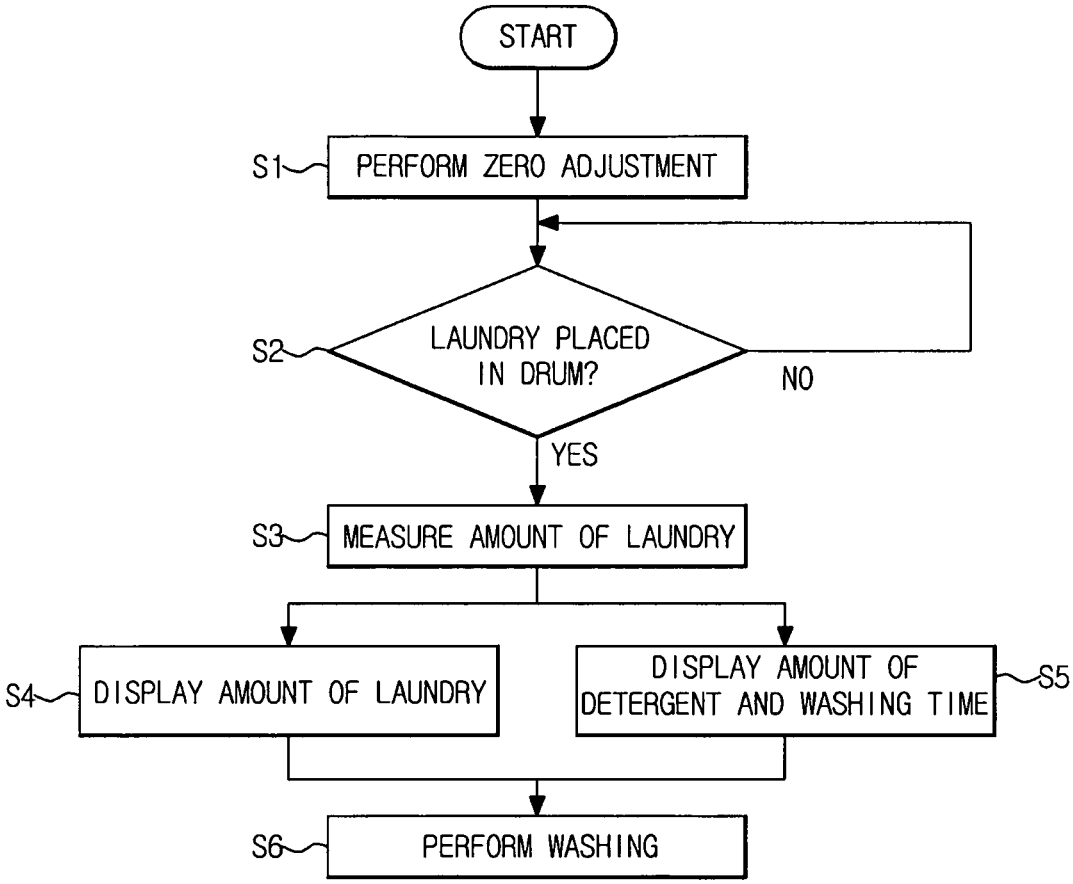
FIG. 7 is a flow chart illustrating an operation sequence of the washing machine according to the embodiment.

FIG. 5 is a sectional view of the deformation amount measurement unit before laundry is placed in the washing machine according to the embodiment of the present invention, and FIG. 6 is a sectional view of the deformation amount measurement unit after laundry is placed in the washing machine according to the embodiment. FIG. 7 is a flow chart illustrating an operation sequence of the washing machine according to the embodiment.

As shown in FIGS. 5 to 7, the washing machine may use water, detergent and electricity in proportion to an amount of laundry using the laundry amount detection device 40. When current is supplied to the laundry amount detection device 40, zero adjustment of the laundry amount detection device 40 is performed (S1). The controller 42 may detect a deformation amount of the elastic member 14 based on the weight of the tub 11 before laundry is placed in the drum 12, as shown in FIG. 5, through the deformation amount measurement unit 41 and perform zero adjustment based on an output value.

Subsequently, when laundry is placed in the drum 12, the laundry amount detection device 40 measures the amount of the laundry (S2).

The controller 42 may detect a deformation amount of the elastic member 14 based on the increase in weight of the tub 11 after the laundry is placed in the drum 12, as shown in FIG. 6, through the deformation amount measurement unit 41. Subsequently, the controller 42 calculates the deformation amount of the elastic member 14 to measure the amount of the laundry (S3). At this time, the controller 42 may use an estimation table in which a deformation amount of the elastic member 14 corresponds to an amount of laundry.

The microprocessor of the washing machine may perform the function of the controller 42. That is, the microprocessor calculates the deformation amount of the elastic member 14 to measure the amount of the laundry (S3). At this time, the microprocessor may use an estimation table in which a deformation amount of the elastic member 14 corresponds to an amount of laundry.

Subsequently, the controller 42 controls the measured amount of the laundry to be displayed on the control panel (S4), or controls an amount of detergent and washing time corresponding thereto to be displayed on the control panel (S5).

Subsequently, the washing machine performs washing based on the amount of detergent and washing time set according to the amount of the laundry measured by the laundry amount detection device 40 (S6). The amount of detergent and washing time may be used in proportion to the amount of the laundry, thereby saving water and electricity.

Consequently, the washing machine accurately measures the amount of the laundry using the laundry amount detection device 40 and uses water and electricity in proportion to the amount of the laundry, thereby maximizing energy use efficiency.

Figure 8:
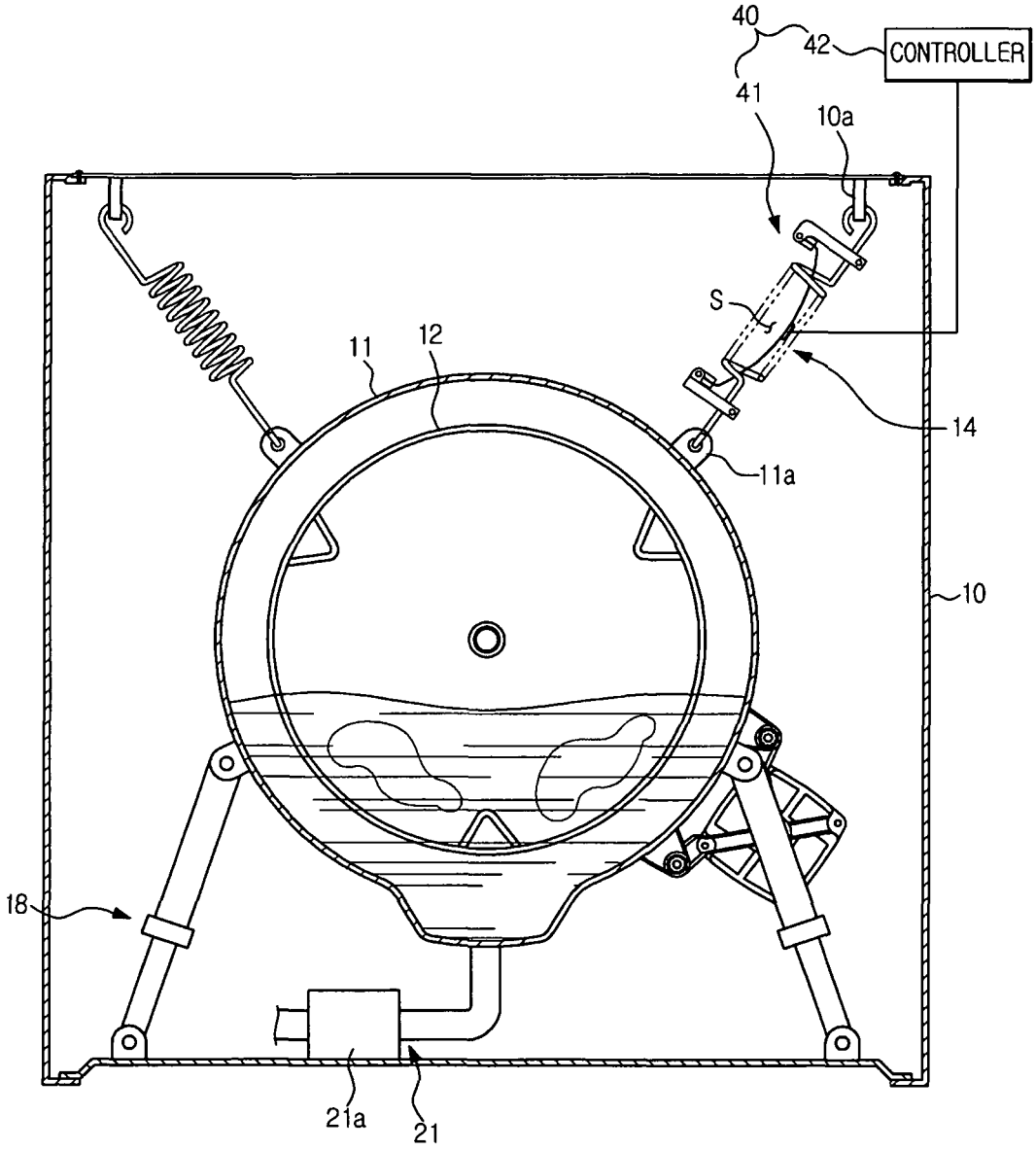
FIG. 8 is a sectional view of a washing machine according to another embodiment.

FIG. 8 is a sectional view of a washing machine according to another embodiment of the present invention.

As shown in FIG. 8, the laundry amount detection device 40 may include a deformation amount measurement unit 41 and a controller 42. The deformation amount measurement unit 41 may include a load cell 50 and a position fixing member 60. The load cell 50 and the position fixing member 60 are mostly identical to those described with reference to FIGS. 1 to 7. In this embodiment, however, the load cell 50 may be inserted into a predetermined space S defined by the spiral part 15 of the elastic member 14, as shown in FIG. 8. In the structure as shown in FIG. 8, the deformation amount measurement unit 41 is prevented from being damaged due to external impact.

In the washing machine as shown in FIGS. 1 to 8, the laundry amount detection device 40 may be integrated with the elastic member 14 as a module. Consequently, a user may handle the laundry amount detection device 40 and the elastic member 14 as the module, whereby assembly efficiency of the washing machine is improved.

Also, the laundry amount detection device 40 very accurately measures force applied to the elastic member 14, whereby the amount of laundry is accurately measure, which reduces energy consumption.

In the previous embodiments, the washing machine was described as an example; however, embodiments are not limited thereto. Embodiments relate to a device to accurately measure an amount of laundry, and therefore, embodiments may be applied to various electric home appliances, such as a clothing dryer, which may detect an amount of clothing.

As is apparent from the above description, water and electricity are supplied in proportion to an amount of laundry, thereby improving energy use efficiency of the washing machine.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A laundry amount detection device comprising:

an elastic member to elastically support a tub at a cabinet; and a deformation amount measurement unit to measure a deformation amount of the elastic member to detect an amount of laundry placed in the tub, wherein the deformation amount measurement unit comprises a load cell having an elastically deformable body and a strain gauge; and a position fixing member to fix the load cell to the elastic member.

2. The laundry amount detection device according to claim 1, wherein at least a portion of the laundry amount detection device is configured to move relative to deformation of the elastic member.

3. The laundry amount detection device according to claim 1, further comprising a controller to calculate the amount of the laundry using a value measured by the deformation amount measurement unit.

4. The laundry amount detection device according to claim 1, wherein the position fixing member comprises a stationary part coupled to the elastic member and a movable part coupled to the load cell, and the movable part is pivotably coupled to the stationary part.

5. The laundry amount detection device according to claim 4, wherein the stationary part and the movable part are coupled to each other via a pin.

6. The laundry amount detection device according to claim 1, wherein the elastically deformable body is disposed in a predetermined space inside the elastic member.

7. A washing machine comprising:

a cabinet;

a tub provided in the cabinet;

an elastic member to elastically support the tub at the cabinet; and a laundry amount detection device to detect an amount of laundry placed in the tub using a deformation amount of the elastic member, wherein the laundry amount detection device comprises a deformation amount measurement unit to measure the deformation amount of the elastic member, and the deformation amount measurement unit comprises a load cell having an elastically deformable body and a strain gauge, and a position fixing member to fix the load cell to the elastic member.

8. The washing machine according to claim 7, wherein at least a portion of the laundry amount detection device is configured to move relative to deformation of the elastic member.

9. The washing machine according to claim 7, wherein the laundry amount detection device further comprises a controller to transmit a value measured by the deformation amount measurement unit to a microprocessor of the washing machine, and the microprocessor receives the measured value from the controller and calculates the amount of the laundry.

10. The washing machine according to claim 7, wherein the laundry amount detection device further comprises a controller to calculate the amount of the laundry using the value measured by the deformation amount measurement unit and to transmit the calculated amount of the laundry to a microprocessor of the washing machine.

11. The washing machine according to claim 7, wherein the elastically deformable body is deformed in proportion to deformation of the elastic member.

12. The washing machine according to claim 7, wherein the elastically deformable body is arranged in a longitudinal direction of the elastic member and is formed in an arc shape.

13. The washing machine according to claim 7, wherein the elastically deformable body is disposed in a predetermined space inside the elastic member.

14. The washing machine according to claim 13, wherein the stationary part has an elastic member coupling part, and the elastic member coupling part is threadedly coupled to the elastic member.

15. The washing machine according to claim 13, wherein the movable part has an elastically deformable body coupling part, and the elastically deformable body coupling part is threadedly coupled to the elastically deformable body.

16. The washing machine according to claim 13, wherein the stationary part and the movable part are coupled to each other via a pin.

17. The washing machine according to claim 7, wherein the position fixing member comprises a stationary part coupled to the elastic member and a movable part coupled to the load cell, and the movable part is pivotably coupled to the stationary part.

18. The washing machine according to claim 7, wherein the position fixing member comprises a first position fixing member and a second position fixing member, and the first position fixing member connects one side of the load cell and one side of the elastic member while the second position fixing member connects the other side of the load cell and the other side of the elastic member.

19. The washing machine according to claim 7, wherein the elastic member comprises a spring.

20. The washing machine according to claim 7, further comprising a control panel to display the amount of the laundry measured by the laundry amount detection device.

21. The washing machine according to claim 7, further comprising a control panel to display an amount of detergent or washing time previously set according to the amount of the laundry measured by the laundry amount detection device.

* * * * *